United States Patent [19]

Camp

[11] Patent Number: 4,651,607

[45] Date of Patent: Mar. 24, 1987

[54] MAT CUTTER GUIDE

[76] Inventor: William O. Camp, 2 Bayberry Dr., Newport News, Va. 23601

[21] Appl. No.: 739,439

[22] Filed: May 30, 1985

[51] Int. Cl.[4] ..... B26D 7/26

[52] U.S. Cl. ..... 83/467 R; 83/614; 83/745; 269/291; 269/304

[58] Field of Search ..... 83/455, 466, 468, 522, 83/486; 269/87, 87.1, 290, 291, 303, 304

[56] References Cited

U.S. PATENT DOCUMENTS

| | | | |
|---|---|---|---|
| 823,685 | 6/1906 | Howard | 269/87.1 |
| 4,018,120 | 4/1977 | Pastore | 83/455 |
| 4,098,160 | 7/1978 | Weil | 83/522 |

*Primary Examiner*—Frank T. Yost
*Assistant Examiner*—Hien H. Phan
*Attorney, Agent, or Firm*—Nies, Webner, Kurz & Bergert

[57] ABSTRACT

A stiff board has raised strips with upstanding straight edges at right angles to one another, providing abutment edges against which adjacent edges of the mat are engaged. An adjustable cutter guide bar having a stop adjacent one end is positioned by means of upstanding pins on the board adjacent the first-mentioned straight edge thereon; and on the cutter guide bar are similar plates, each having a diagonal row of equi-spaced holes selectively engageable over the pins. According to which holes are selected for pin engagement, the straight edge on the cutter guide bar is disposed a certain distance from the upstanding straight edge on the board and the end stop on the cutter guide bar is disposed an equal distance from the other upstanding edge on the board.

2 Claims, 3 Drawing Figures

MAT CUTTER GUIDE

FIELD OF INVENTION

Cutting, with work mobilizer, guide for traveling cutter in class 83, subclass 455.

OBJECTS

The primary object of this invention is to provide a guide for cutting mats for pictures, wherein a traveling cutter is moved along a straight edge of a cutter guide which is spaced inwardly a predetermined distance from an outer edge of the mat. In this configuration, wherein the four edges of a rectangular mat are successively disposed beneath the cutter guide, it is intended to provide not only for adjustment of the cutter guide towards and away from an edge on a supporting board for predetermined increments of distance, but also automatically and simultaneously adjusting an end stop on the cutter guide similar distances from an adjacent edge on the mat. In other words, if the cutter guide bar is spaced "x" inches from the edge on the supporting board (against which one of the mat edges is engaged), the end stop on the cutter guide bar will automatically be set at a similar or proportional distance inwardly from an adjacent edge of the mat.

This invention automatically solves a most difficult problem previously inherent in the use of a mat cutter, namely, where to stop the mat cutter so that the cutting edge of the blade will stop precisely at an inner corner of the mat.

In furtherance of the foregoing object, it is also intended to provide for adjustment of the cutter end stop along the length of the cutter guide bar so as to compensate for mat cutters of different makes wherein the distance from the blade edge to the nose of the cutter varies from make to make.

These and other objects will be apparent from the following specification and drawing, in which.

Figure 1:
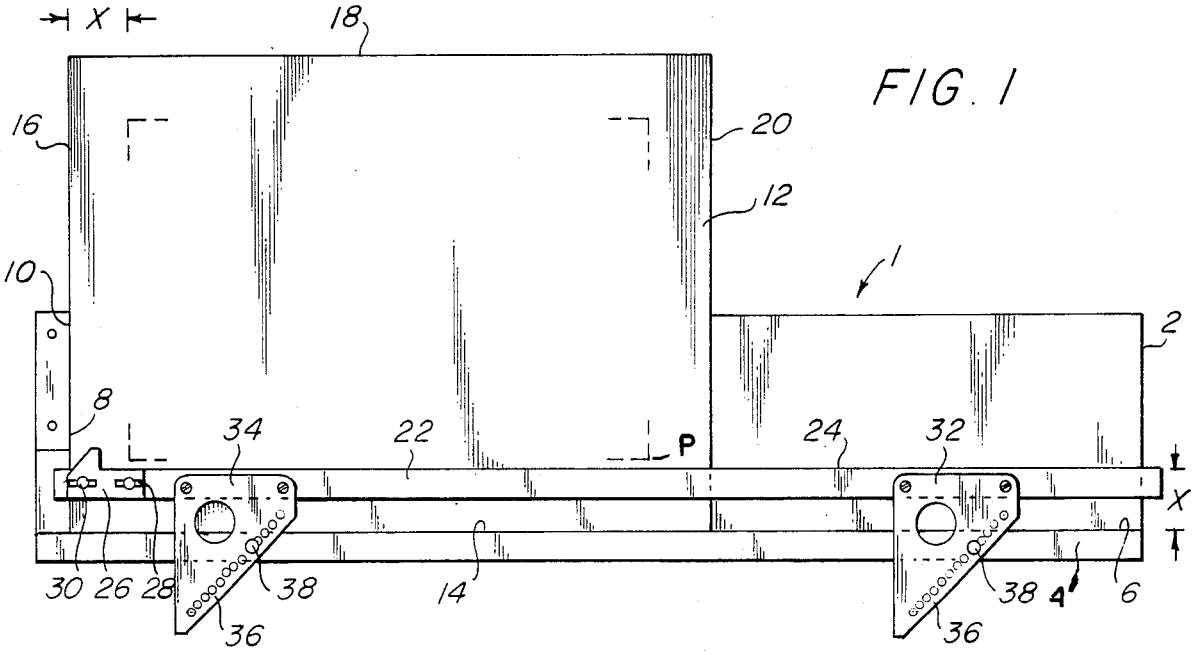
FIG. 1 is a plan view of the mat cutter guide positioned for one marginal dimension.
Figure 2:
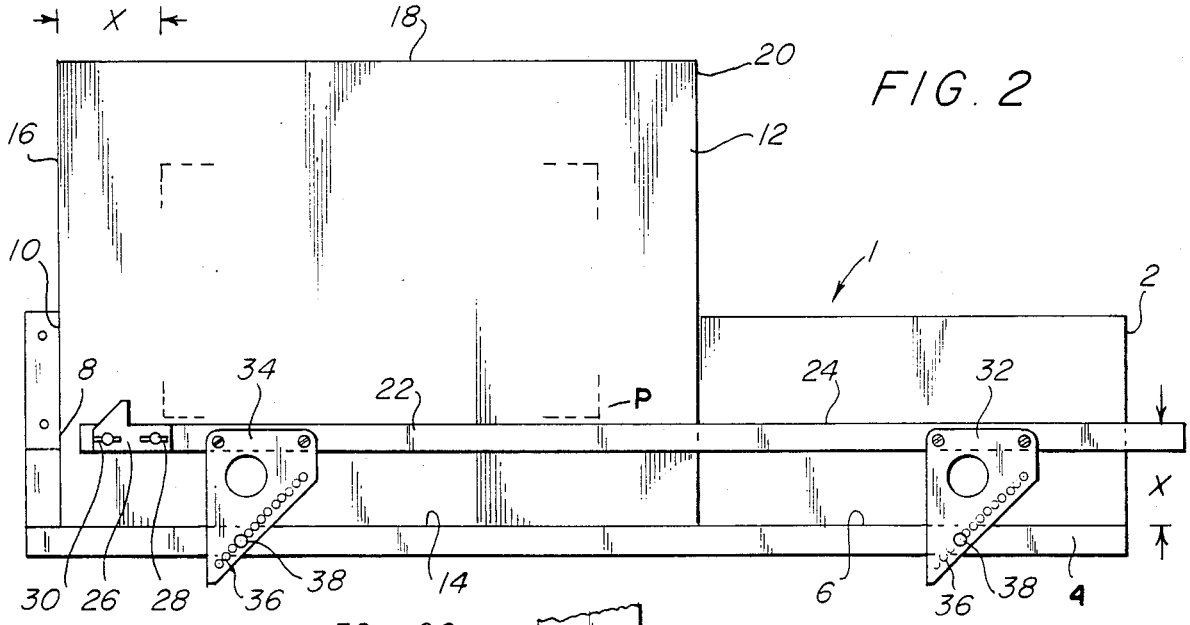
FIG. 2 is a view similar to FIG. 1, but showing the mat cutter guide positioned for a longer marginal dimension.
Figure 3:
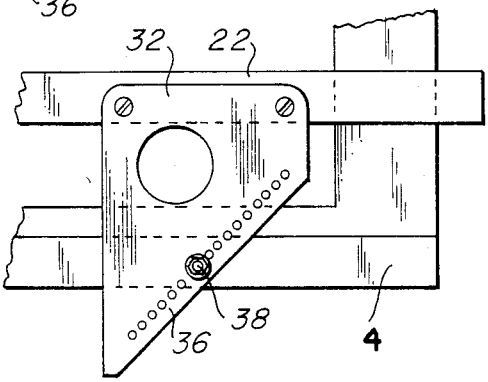
FIG. 3 is a fragmentary plan view showing details of the plates, holes and pins.

Referring now to the drawing, the guide 1 consists of a board 2, preferably stiff, having a strip 4 along one edge which provides an upstanding straight edge 6. Another strip 8 adjacent the end of strip 4 provides an upstanding edge 10. The guide is for cutting between borders of a rectangular mat 12 having, in this example, outer edges 14, 16, 18 and 20. In the illustrated device, mat edge 14 is engaged against the upstanding edge 6 of strip 4 and mat edge 16 engaged against the upstanding edge 10 of strip 8.

A bar 22 moveably disposed over mat 12 provides a straight edge 24 which, as will be apparent hereinafter, is maintained in parallelism with the upstanding edge 6 of strip 4. At the left hand end of bar 22 is an end stop 26 which is adjustable lengthwise of bar 22 by means of screws 28 engaging in slots 30. The lengthwise adjustability of cutter stop 26 is to accommodate the guide to cutters of various makes which have their blade edges disposed at different distances from the cutter nose.

The straight edge 24 of bar 22 is maintained parallel to the straight edge 6 on strip 4 by two similar plates 32 and 34 each having a diagonal row of holes 36 therethrough. The lines of holes 36 are at an angle of 45° with straight edge 24 on bar 22 and in the example given, the holes are spaced 0.177 inches from one another. Holes 36 are engageable over pins 38 on strip 4; and with the row of holes forming a 45° interior angle to straight edge 24 on bar 22, the adjustment from one hole to the next provides an incremental adjustment of the spacing between straight edge 24 on bar 22 and straight edge 6 on strip 4 of 0.125 inches per hole. Since the rows of holes 36 are at 45° to straight edge 24 on bar 22 it will be seen that when an adjustment is made from one hole to another, bar 22 is likewise moved 0.125 inches, thereby moving cutter stop 26 the same distance to the right or left, depending upon whether the pin selection is made to move bar upwardly or downwardly with respect to straight edge 6 on strip 4.

In operation, a mat 12 is placed with its adjacent edges against straight edge 6 on strip 4 and edge 10 on strip 8 and a measurement is made to start the cut at a point p on the mat, which is spaced at a certain distance from the outer edge of the mat. This is the only measurement required for cutting all of the four inner edges of the mat. The first cut is made at a predetermined distance from the edge 14 of the mat, and when the first cut has been completed the mat is turned so as to present the mat edge 16 against edge 6, and the second cut is made; likewise the third and fourth cuts are made by turning the mat 90° for each cut.

If desired, the border adjacent mat edge 16, for example, may be made wider than the border adjacent the opposite mat edge 20 by taping a temporary cutter end stop on the regular end stops 26.

I claim:

1. A mat cutter guide for rectangular mats, comprising:

a generally flat board having a first member, providing a first upstanding edge constituting an abutment for one outer edge of the mat and a second member providing a second upstanding edge disposed at right angles to the first upstanding edge and constituting an abutment for an adjacent edge of the mat, a movable bar adapted to overlie the mat and having a straight edge for guiding a mat cutter, an end stop on the bar for stopping the cutter at a predetermined distance from said adjacent edge of the mat when the mat edge is engaged against said second upstanding edge, and means for maintaining the straight edge at any one of a plurality of selected distances while simultaneously disposing the end stop at a corresponding distance from said adjacent edge of the mat when the mat edge is engaged against the upstanding edge on the second member, said means for maintaining the straight edge on the bar parallel to and spaced from the first upstanding edge on the board comprising a spaced pair of similar plates affixed on said bar and adapted to overlie said first member, each of said plates having a series of holes disposed at spaced intervals along lines similarly disposed at angles with respect to said straight edge, and upstanding pins on said first member selectively engageable through said holes, the lines upon which said holes are disposed and said straight edge means defining interior angles of 45° facing said stop means.

2. A mat cutter guide for rectangular mats as claimed in claim 1 wherein said stop means being adjustable lengthwise on the bar.

* * * * *